US007954402B2

(12) United States Patent
Crawford

(10) Patent No.: US 7,954,402 B2
(45) Date of Patent: Jun. 7, 2011

(54) RATCHET WRENCH WITH SOCKET QUICK RELEASE MECHANISM

(76) Inventor: Ted C. Crawford, Denver, CO (US)

( * ) Notice: Subject to any disclaimer, the term of this patent is extended or adjusted under 35 U.S.C. 154(b) by 226 days.

(21) Appl. No.: 11/794,396

(22) PCT Filed: Dec. 30, 2005

(86) PCT No.: PCT/US2005/047525

§ 371 (c)(1),
(2), (4) Date: May 27, 2008

(87) PCT Pub. No.: WO2006/072026

PCT Pub. Date: Jul. 6, 2006

(65) Prior Publication Data

US 2010/0132517 A1 Jun. 3, 2010

(51) Int. Cl.
*B25B 13/46* (2006.01)
*B25B 23/00* (2006.01)

(52) U.S. Cl. ..... 81/63; 81/177.85

(58) Field of Classification Search ..... 81/60, 63, 81/63.2, 58, 58.4, 177.85
See application file for complete search history.

(56) References Cited

U.S. PATENT DOCUMENTS

| | | | | |
|---|---|---|---|---|
| D170,688 | S | 10/1953 | Gerlach | |
| 3,208,318 | A | 9/1965 | Roberts | |
| 4,336,728 | A | 6/1982 | Deibert | |
| 4,420,995 | A | 12/1983 | Roberts | |
| 4,735,120 | A | 4/1988 | Beugelsdyk | |
| 4,793,222 | A | 12/1988 | Beugelsdyk | |
| 4,901,607 | A | 2/1990 | Beugelsdyk et al. | |
| 4,974,475 | A | 12/1990 | Lord et al. | |
| 5,038,452 | A | 8/1991 | Beugelsdyk et al. | |
| 5,231,903 | A * | 8/1993 | Bockman, Jr. | 81/63.2 |
| 5,582,080 | A * | 12/1996 | Barmore | 81/63 |
| 5,620,073 | A | 4/1997 | Marks | |
| 5,626,062 | A * | 5/1997 | Colvin | 81/63.2 |
| 6,101,901 | A | 8/2000 | Daigle | |
| 6,109,140 | A | 8/2000 | Roberts et al. | |
| 6,205,890 | B1 * | 3/2001 | Roberts et al. | 81/63 |
| 6,220,125 | B1 | 4/2001 | Lan | |
| 6,230,591 | B1 | 5/2001 | Ling et al. | |
| 6,260,447 | B1 * | 7/2001 | Hutt | 81/63 |
| 6,431,031 | B1 | 8/2002 | Hu | |
| 6,666,112 | B2 * | 12/2003 | Hu | 81/63.1 |
| 6,708,586 | B1 | 3/2004 | Chen | |
| 6,722,233 | B2 | 4/2004 | I-He | |
| 2003/0012614 | A1 * | 1/2003 | Hu | 409/132 |

* cited by examiner

*Primary Examiner* — David B Thomas
(74) *Attorney, Agent, or Firm* — Holland & Hart LLP

(57) ABSTRACT

A ratchet wrench includes a working head located forwardly on a handle. The working head has a body portion with a generally flat and generally uninterrupted upper surface and a cavity formed in an opposite lower surface with at least one actuator bore through the side wall of the body portion. A drive item is rotatably disposed in the cavity. A pawl item is disposed in the cavity to switch the drive direction of the drive item, and a pawl actuator pin is movably disposed in the actuator bore to switch the pawl. A retention plate may be used to mount the drive item and pawl item in the cavity plate. A quick release mechanism may include a longitudinally oriented and longitudinally slideable release actuator. The upper surface of the working head may be formed by the body portion or by a cover plate mounted thereto.

29 Claims, 10 Drawing Sheets

12
14
14
16
17
18
19
20
22
24
26
28
30
32
32
34
36
36
38
38
40
41
42
44
50
52
54
56
58
60
62
63
64
66
66
68
70
72
74
76
78
80
80
88
88
90
92
94
94
94
94
94
96
96
96
96
96
98
98
100
100

RATCHET WRENCH WITH SOCKET QUICK RELEASE MECHANISM

The present invention broadly concerns tools and specifically relates to wrenches such as ratchet wrenches, some of which are know to mount interchangeable sockets for different bolt head sizes. According to the disclosed embodiments, the wrench is structured to have an generally flat and generally uninterrupted upper surface on the working head. In addition, the disclosed embodiments provide pawl actuating pins that extend laterally of the working head. This disclosure also provides an improved quick release mechanism especially adapted for use with ratchet wrenches that mount sockets thereon.

BACKGROUND OF THE DISCLOSURE

One of the more versatile tools used by mechanics and the like is the ratchet wrench. As is known, ratchet wrenches include a handle and a working head. Some ratchet wrenches directly engage a work piece, such as a nut or bolt head. Other ratchet wrenches have a drive stud projecting from a rotatable drive member, also sometimes referred to as a ratchet wheel. This drive stud is typically integral with the drive member. A ratchet mechanism selectively engages the drive member to permit rotation of the drive member in one direction while preventing rotation in a second, opposite rotational direction. The ratchet mechanism is actuable so as to selectively permit rotation of the drive member in either a clockwise or counterclockwise direction. Usually, a lever is provided on the working head to allow the user to select the desired rotation of the drive stud.

The drive stud, in turn, receives a selected one of a plurality of sockets, socket adapters, extenders, and the like, which may be referred to as a work piece that engages the nut or bolt head. A socket, for example, has an opening sized and adapted to receive the drive stud. A second opening is located oppositely of the drive stud opening with this second opening having teeth and an opening sized to receive a nut, bolt head and the like. A set of such sockets is usually provided allowing the user to interchange sockets for differently sized nuts and bolts. Adapters and extenders have an opening to receive the drive stud and an opposite drive stud to receive a socket or other piece.

One disadvantage of existing ratchet wrenches is that, typically, portions of the operative mechanism project through the upper surface of the working head. These protruding mechanical elements act to increase the effective thickness of the working head. In addition, they can sometimes interfere with the use of the wrench, especially in confined spaces. Moreover, the protruding elements clutter the working head upper surface and do not permit the upper surface to receive identifying logos or other designations of desired size.

The drive stud on the working or "ratchet head" also often employs a ball detent to retain the selected socket, adapter or extender on the drive stud. To remove the socket, the user typically grips the head of the wrench in one hand and the socket in the other in order to separate the socket from the wrench head. Sometimes, removal of the socket from the drive stud is difficult. This can arise should dirt effect the actuation of the ball detent. Other times, should the user's hands be oily or greasy, it is difficult to obtain sufficient grip on the cylindrical socket in order to effect separation. Indeed, small variations due to manufacturing tolerances can exacerbate the difficulty of removal of the socket, adapter, extender, etc.

In order to ease the procedure of removing a socket from the drive stud, it is known to provide ratchet wrenches with a "quick release" mechanism. An early example of a quick release mechanism is disclosed in U.S. Pat. No. 3,208,318 issued Sep. 28, 1965 to Roberts. Here, the detent ball interacts with a cavity on a release pin which is axially disposed in the drive stud and is reciprocal in the longitudinal direction. The release pin has a head that protrudes from the wrench, opposite the drive stud, to provide a button whereby a user can depress the release pin against the force of a return spring. Depressing the release pin moves the cavity into registration with the detent ball so that there is no spring actuated force on the detent ball allowing the socket to be easily removed. When released, the release pin is biased so that it presses against the detent ball thereby retaining the socket on the drive stud. Another example of a quick release mechanism is disclosed in U.S. Pat. No. 4,420,995 issued Dec. 20, 1983 to Roberts. Here, the reciprocating release pin is rotatable to provide a positive locking structure for the detent ball.

While the above-described mechanisms are reliable and effective in use, the possibility exists that, under some conditions, a user may inadvertently depress the release pin while using the wrench. This can happen, for example, if the head of the wrench is placed in the palm of the users hand since the hand can come in contact with the button or head of the release pin and can inadvertently depress the same while the wrench is used thereby inadvertently releasing the socket.

In order to overcome these drawbacks, a slide actuator for the release pin is disclosed in U.S. Pat. No. 6,109,140 issued Aug. 29, 2000 to Roberts et al. In this structure, the head of the release pin is not exposed exteriorly of the working head. Rather, a slide actuator projects upwardly from the drive head directly above the release pin and reciprocates in a direction transverse to the rotational axis of the drive stud and thus the longitudinal axis of the release pin. The slide actuator has a ramp face which attacks the head of the release pin so that reciprocation of the slide actuator acts to depress or release the release pin.

Again, the structure disclosed in the '140 patent is generally reliable and effective. However, the slide actuator requires that the user adjust his/her grip on the handle or use his/her other hand while gripping the wrench in order to employ the quick release. In addition, the wrench disclosed in the '140 patent has the ratchet reversing lever located on the head of the wrench which results in multiple mechanisms presenting a cluttered appearance for the head. In addition, since the slide actuator projects upwardly from the working head, it can interfere with using the wrench in confined spaces.

Accordingly, there remains a need for improved ratchet wrenches having a more streamlined appearance including generally flat and generally uninterrupted upper surfaces. A need exists, also, for ratchet wrenches that incorporate improved quick release mechanisms for the sockets used therewith. There is a need for ratchet wrenches that have pawl control release mechanisms that are convenient and more accessible to the user. There is a further need for quick release mechanisms having simplified structure. There is also a need for ratchet wrenches having quick release mechanisms wherein the working head has a reduced profile.

SUMMARY OF THE DISCLOSURE

It is an object of the present invention to provide a new and useful wrench, and especially, a new and useful ratchet wrench assembly.

It is an aspect of the disclosed embodiments of the present invention to provide a ratchet wrench wherein the directional ratchet pawl controls are located laterally of the ratchet wrench.

Another aspect of the disclosed embodiments of the present invention is to provide a ratchet wrench structure that has an uninterrupted upper surface that is opposite a drive portion so as to provide an area for custom labeling.

Yet another aspect of the disclosed embodiments of the present invention is to provide a ratchet wrench having an uninterrupted surface to provide an area for embossing selected designs or indicia.

A further aspect of the disclosed embodiments of the present invention is the provision of a new and useful ratchet wrench with an improved quick release mechanism.

Still a further aspect accomplished by the exemplary embodiments disclosed herein is the provision of an actuator for a quick release mechanism that is easily accessible to the user whereby the user may release a socket with the same hand that is holding the handle of the wrench.

Yet another aspect of the exemplary embodiments is the construction of a ratchet wrench having a quick release mechanism wherein the working head has a reduced profile.

A still further aspect of the disclosed embodiments of the present invention is to provide an improved pawl and pawl actuator mechanism for the drive member of a ratcheting assembly.

According to the present invention, a ratchet wrench is provided which is adapted to engage a work piece whereby a user may apply a rotational force thereto with mechanical advantage. According to the exemplary embodiments described herein, the ratchet wrench broadly includes a forwardly located working head having a generally flat and generally uninterrupted upper surface and a lower surface opposite the upper surface. The working head includes a body portion that has a cavity formed therein that has a cavity opening to the lower surface of the working head such that the body portion includes a body side wall surrounding the cavity and an outer body side surface. The body portion has at least one actuator bore formed through the body side wall. A handle extends longitudinally and rearwardly of the working head along the longitudinal axis. A drive member is rotatably disposed in the cavity for rotation and are opposite first and second rotational directions about a rotational axis with the rotational axis being generally perpendicular to the longitudinal axis. This drive member is adapted to engage the work piece. A pawl member is disposed in the cavity and is selectively moveable between first and second pawl positions. When the pawl member is in the first position, it is operative to permit the drive member to rotate in the first rotational direction and to prohibit the drive member from rotation in the second rotational direction. When the pawl member is in the second position, it is operative to permit the drive member to rotate in the second rotational direction and to prohibit the drive member from rotation in the first rotational direction. At least one pawl actuator pin is provided with this actuator pin being disposed in the actuator bore and being moveable between first and second actuator positions. The pawl actuator pin engages the pawl member such that, when it is in the first actuator position, the pawl member is in the first pawl position and such that, when the pawl, actuator pin is in the second actuator position, the pawl member is in the second pawl position.

In one of the disclosed embodiments, the upper surface of the working head is formed by an upper surface of the body portion. In another embodiment, a cover plate is provided which is mounted to the body portion. The cover plate has a lower cover surface that confronts the body portion and an upper cover surface defining the generally flat and generally uninterrupted upper surface of the working head. While the cover plate may be mounted in any convenient manner, in the disclosed embodiment, the body portion has an plurality of locking ports formed therein, and the cover plate includes a plurality of locking posts formed on the lower cover surface thereof. These locking posts are positioned to engage the locking ports thereby to secure the cover plate to the body portion. Moreover, in the disclosed embodiments, the outer body side surface is curved between the upper and lower surfaces of the working head. The cover plate then has an outer cover plate edge margin that is rounded so as to present a continuation of the outer body side surface when mounted on the body portion.

In the disclosed embodiments, the body portion has first and second actuator bores formed through the body sidewall. A first pawl actuator pin is disposed in the first actuator bore and a second pawl actuator pin is disposed in the second actuator bore. The first and second pawl actuator pins both engage the pawl member with each being moveable between first and second actuator positions. When the first pawl actuator pin is in the first actuator position, the second pawl actuator pin is in the second actuator position thereby placing the pawl member in the first pawl position. However, when the first pawl actuator pin is in the second actuator position, the second pawl actuator pin is in the second actuator position thereby to place the pawl member in the second pawl position.

In the disclosed embodiments, the pawl actuator pins include an enlarged head at a distal end thereof which head has a central axis. A rod extends from the enlarged head along a rod axis to terminate in a distal end portion that engages the pawl member. In some embodiments, the pawl member includes a pawl head and a tongue extending therefrom. A pawl post is disposed on the tongue. The pawl actuator pin or pins include an annular ring at the proximal end thereof that is sized and adapted to engage the pawl post. Moreover, in some embodiments, the rod axis is offset from the central axis of the enlarged head and the annular rings are flattened to have a thickness of about one-half the diameter of the rod. The rod axis can also be oriented at an acute angle with respect to a transverse axis that is generally perpendicular to both the longitudinal axis and the rotational axis. This acute angle may be selected as desired, but in some embodiments, is oriented at an angle range of about fifteen to sixty degrees. Furthermore, the body portion may include a shroud disposed around at least a portion of the actuator bore or bores with such shrouds being operative to shield the enlarged head of the pawl actuator panel pins.

In the disclosed embodiments, a retention plate is provided and is mounted to the body portion. This retention plate is sized and adapted to secure the drive member and the pawl member within the cavity when in the mounted state. The body side wall can have a retainer groove formed along an inner side surface thereof with this groove extending at least part way around the cavity. A retainer clip is then provided with the retainer clip adapted to removeably engage the retainer groove thereby to mount the retention plate to the body portion. Moreover, in the disclosed embodiments, the body side wall has an interior shoulder formed thereon with the retainer groove being spaced from the shoulder such that the retention plate is seated against the shoulder when in the mounted state. The cavity in the body portion may be generally oval in shape, and the retainer clip can be generally u-shaped in configuration. A seal member can be disposed between the drive member and the retention plate.

The drive member can include an upper drive portion having a cylindrical configuration with this drive portion being provided with a plurality of peripheral drive teeth. A drive stud can project axially of the drive portion. Here, the pawl member includes pawl teeth operative to engage the drive teeth with the drive stud being operative to engage the work piece either directly or through a removable socket. In the disclosed embodiments, a quick release mechanism is associated with the drive stud. This release mechanism has a retain state that assists in retaining the work piece thereon and a release state wherein the work piece is released from the drive stud. The quick release mechanism can further include a longitudinally oriented and longitudinally moveable release actuator disposed in the working head. This release actuator is operative to slideably move between a retracted position and an advanced position. The release actuator, when in the advanced position, is operative to move the quick release mechanism to release state. The quick release mechanism may be biased toward the retained state, if desired.

The various individual features of the disclosed embodiments may be incorporated in varying combinations. Thus, for example, the pawl structure and the pawl actuator pins can be incorporated into a ratchet wrench that does not have the generally flat and generally uninterrupted upper surface for the working head. Similarly, the quick release mechanism disclosed in the exemplary embodiments may be incorporated with a ratchet wrench that does not have the generally flat and generally uninterrupted upper surface or the particular pawl member and pawl actuator pin structure.

These and other aspects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENTS

The present invention is generally directed to tools, and is particularly directed to ratchet wrenches that incorporate a switchable ratchet mechanism. Several features for the ratchet tool of the present invention provide advantages over the prior art. On one hand, the present invention provides ratchet controls that vary the effective direction of the ratchet mechanism with these controls being oriented laterally of the ratchet head. Not only is this feature more convenient for operation by the user, but further provides for an upper surface that is uninterrupted by a ratchet control lever. Such uninterrupted surface allows a location for the placement of large custom logos, indicia, and the like. If desired, the selected design may be embossed or debossed such that the aesthetic effect created thereby is a raised design, an indented design, or a combination thereof. Other appropriate methods of forming or otherwise placing the design on the uninterrupted surface are also contemplated, such as screen-printing, casting forging, machining, and the like.

The present invention also is generally directed to ratchet wrenches having a quick release mechanism for the sockets used therewith. With the structure described in the exemplary embodiments, a slide actuator is positioned and oriented for convenient, easy use by a person employing the ratchet wrench in a mechanical operation. Moreover, the ratchet wrench described in the exemplary embodiments has a minimum number of parts and is easy to assemble. It further provides a ratchet wrench having a profile of reduced dimension.

Figure 1:
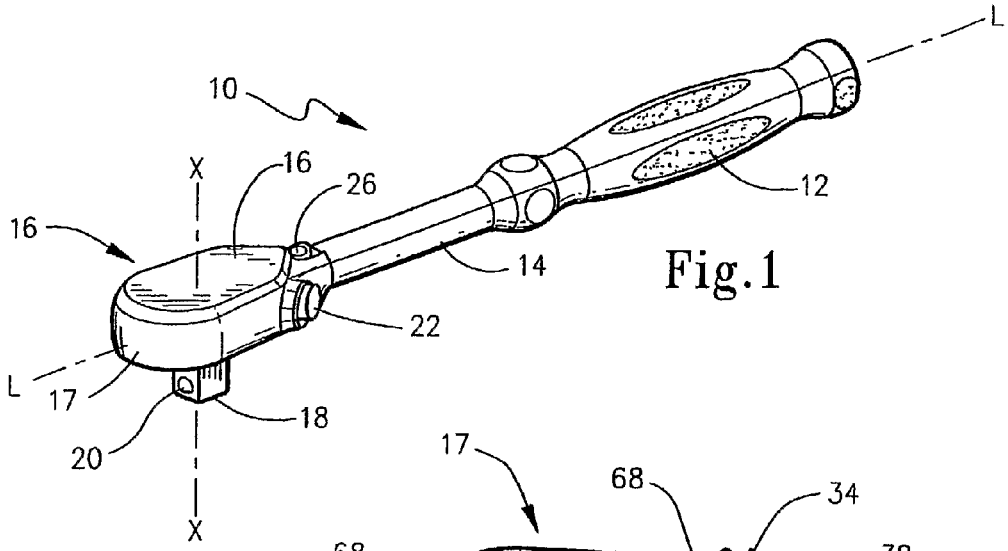
FIG. 1 is a perspective view of a ratchet wrench according to the first exemplary embodiment of the present invention.
Figure 2:
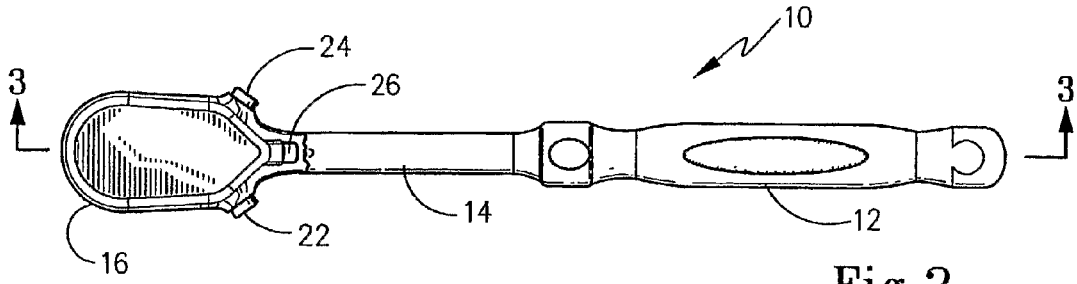
FIG. 2 is a top plan view of the ratchet wrench shown in FIG. 1.
Figure 3:
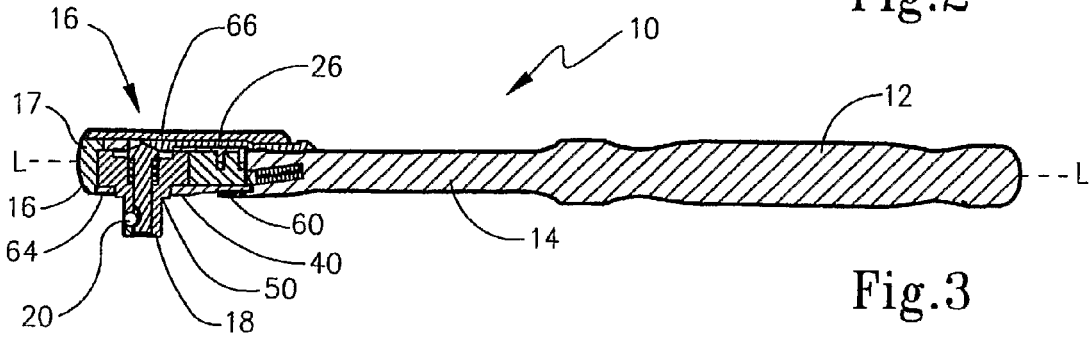
FIG. 3 is a cross-sectional view taken about lines 3-3 of FIG. 2.

Turning first to FIGS. 1-2, a ratchet wrench 10 according to the first exemplary embodiment of the present invention is therefore introduced. The structure of this ratchet wrench 10 is also illustrated in greater detail in FIGS. 3-6. In these figures, ratchet wrench 10 includes a rearwardly located handle 12 provided with a shank 14 that supports a forwardly positioned working head which will be referred to as working head, drive head or ratchet head 16. Ratchet head 16 mounts a rotatable drive shaft or drive stud 18 projecting in a generally perpendicular direction to the longitudinal axis "L" along a drive or rotational axis "X". As shown, ratchet head 16 has a generally flat and generally uninterrupted upper surface. By "flat", it is meant that the surface is either planar or close to planar which would include slightly convex or slightly concave surfaces. By "uninterrupted" it is meant that no portions of the working parts or elements of the ratchet wrench protrude through the surface so as to be exteriorly exposed.

Drive stud 18, as is known in the art, may be controlled by a ratchet mechanism so that, when handle 12 is rotated in one direction in a plane perpendicular to axis "X" drive stud 18 is locked so that mechanical advantage can be used to apply a torque force on a work piece, such as a socket secured thereto or a nut or bolt head. When rotated in the opposite direction, the ratchet mechanism releases so as to allow free movement of the handle in a direction opposite the drive direction while the drive stud 18 remains stationary. However, the ratchet mechanism is switchable so the user may reverse the drive direction and the release direction.

It should be appreciated by the ordinarily skilled person in this field that, while the mechanisms of the present invention are described with respect to a ratchet wrench having drive stud 18, other drive structures could be provided. For example, instead of drive stud 18, the wrench could be a pre-formed cavity adapted to receive a work piece.

In this exemplary embodiment, however, drive stud 18 is adapted to receive various interchangeable sockets and a set of sockets of different sizes for different sized work pieces. Switching of the ratchet mechanism is accomplished by control members in the form of pins 22 and 24. To this end, also, drive stud 18 is provided with a detent ball 20 to facilitate retention of a selected socket on drive stud 18. As described in greater detail below, detent ball 20 is biased radially outwardly from axis "X" by a spring force. The quick release feature of ratchet wrench 10 is controlled by slide actuator 26.

The structure and construction of ratchet wrench 10 is illustrated in greater detail in FIGS. 3-6. Here, it may be seen that wrench 10 has a drive member 40 having a cylindrical upper portion 41 with a plurality of longitudinally oriented drive teeth 42. Drive stud 18 extends longitudinally along rotational axis "X" and is formed integrally with upper portion 41. As described in greater detail below, drive member 40 has a axially oriented bore, with two differing diameters, formed therein so as to receive release pin 50. Detent ball 20 is placed inside this bore and is received in a smaller diameter opening 44 formed to the sidewall of drive stud 18.

A spring 52 is provided to exert an upwardly directed biasing force on release pin 50. To this end, release pin 50 includes an enlarged pin head 54 and a longitudinally extending shaft 56. Shaft 56 has a cutout or bay 58 formed at a distal end thereof opposite pin head 54 with bay 58 interacting with detent ball 20, as described below. Drive member 40 is received in a cavity 70 formed in ratchet head 16 and is retained therein by a seal 60, retention plate 62 and a retainer clip 64. Retention plate 62 is provided with an opening 63 to accommodate drive stud 18. Ratchet head 16 further supports a pawl 30 in cavity 70 and mounts pawl actuator pins 22 and 24. To this end, a pair of openings 32 and 34 receive the pawl actuator pins, and the heads of the pawl actuator pins are protected by shrouds 36 and 38, respectively. Pawl member 30 interacts with drive member 40 to control the ratcheting direction.

Figure 5:
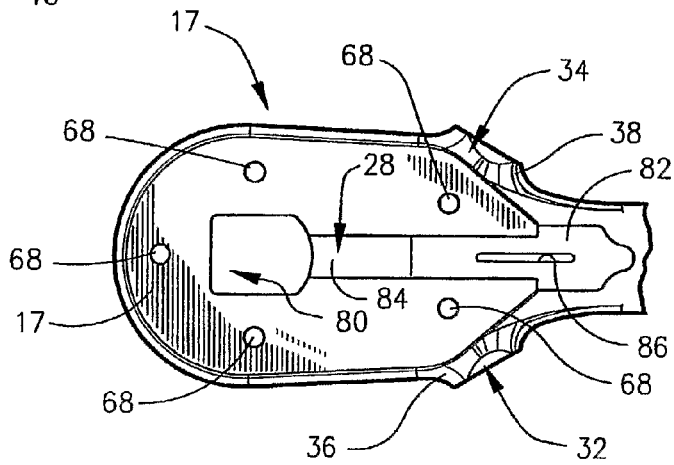
FIG. 5 is a top plan view of the working head of the ratchet wrench shown without the cover plate and the slide actuator.
Figures 4, 6, 7:
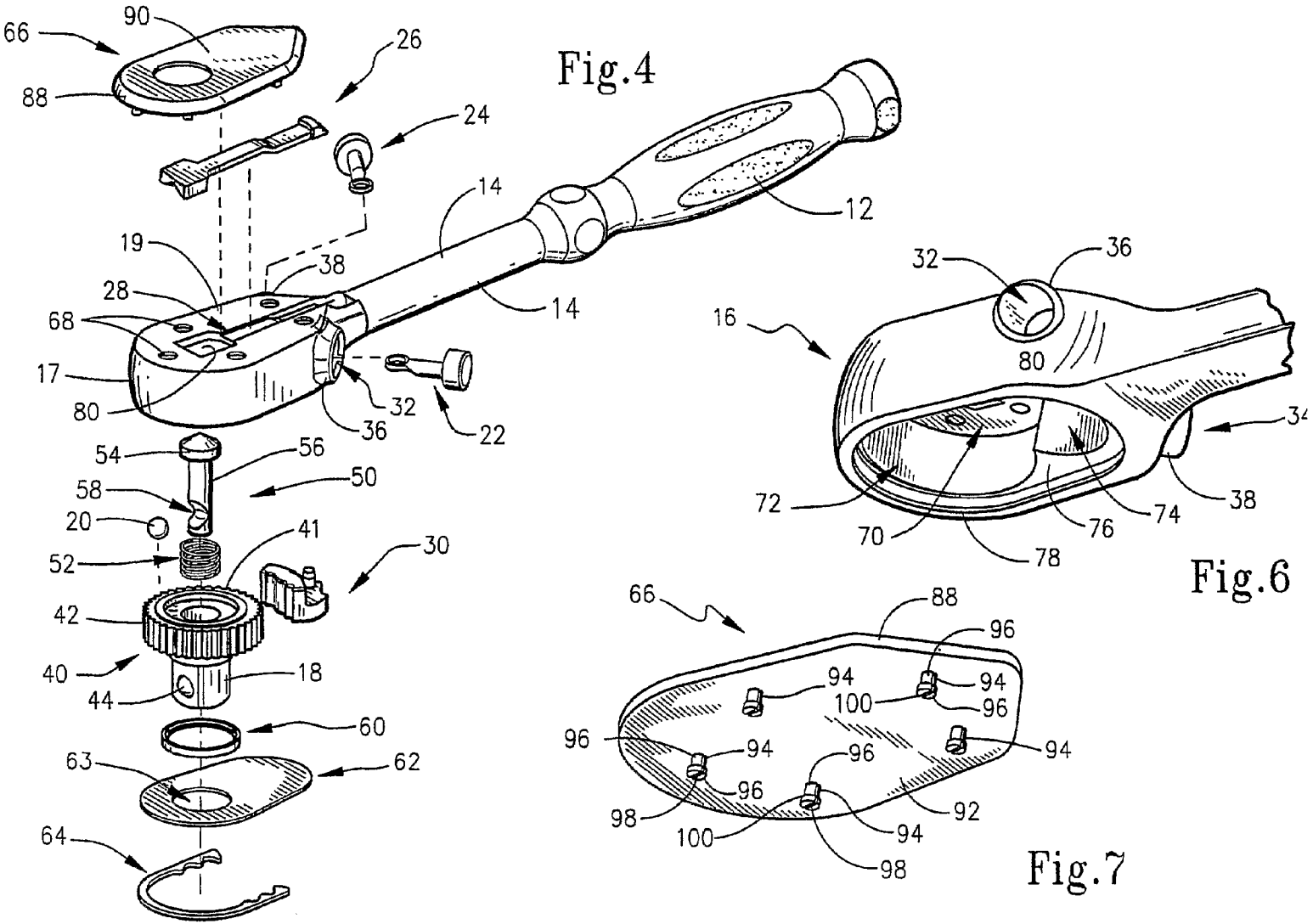
FIG. 4 is an exploded perspective view illustrating the components of the ratchet wrench shown in FIG. 1.
FIG. 6 is a bottom view in perspective showing the working head with the ratcheting mechanism removed therefrom.
FIG. 7 is a bottom view in perspective of the cover plate for the head of the ratchet wrench shown in FIGS. 1-4.

The structure of working head 16 may be appreciated with further reference to FIGS. 5 and 6. Here, it may be seen that working head 16 includes a body portion 17 that has a cavity 70 formed therein which has two intersecting, circular chambers 72 and 74 to receive drive member 40 and pawl member 30. A shoulder or ledge 76 is provided as a seat for retention plate 62, which may be releaseably fastened into position by retainer clip 64 that is received in a groove 78 that extends around the majority of the inner circumference of cavity 70 proximately to shoulder 76. To this end, retainer clip 64 is U-shaped in configuration and is formed of spring steel so as to resiliently lock into groove 78.

As may be further seen with reference to FIGS. 4 and 5, body portion 17 includes a channel 28 which slidably receives a release or slide actuator 26 therein. Slide actuator 26 is retained by a cover plate 66 that mounts onto body portion 17 in any convenient, mechanically sound engagement. For example, in this embodiment, body portion 17 includes a plurality of locking ports or holes 68 adapted to secure cover plate 66 thereon. Other securing structures, such as dove-tail slides, adhesives, etc, could be used to this end. In any event, the upper surface of body portion 17 has a generally rectangular opening 80, and channel 28 intersects opening 80. Channel 28 is stepped so as to have two different depths and includes a lower step 82 and an upper step 84. Upper step 84 has a longitudinally extending groove 86 formed in the bottom surface thereof.

Slide actuator 26 is received in channel 28 for reciprocal movement therein between a retracted position and an advanced position. Slide actuator 26 is retained by cover plate 66 which is further illustrated in FIG. 7. Here, it may be seen that cover plate 66 has a generally flat plate having a rounded edge 88, a top surface 90 (FIG. 4) and a lower surface 92. Cover plate 66 has a perimeter that is generally congruent with the perimeter of the upper surface 19 of body portion 17 such that, when lower surface 92 of cover plate 66 confronts upper surface 19, the perimeter of the junction between the surrounding side wall of body portion 17 and cover plate 66 is generally smooth, arcuate configuration. Lower surface 92 of cover plate 66 has a plurality of split, spring posts or locking posts 94 formed by a pair of spring sections 96 separated by split 98 therebetween and which together form an enlarged locking head 100. Each of locking posts 94 are sized so that they may be forced fit into respective ports 68. When this happens, spring sections 96 are compressed together to allow enlarged head 100 to pass through holes 68. When this is accomplished, locking posts 94 expand so that enlarged head 100 prevent removal of cover plate 66. The use of such locking posts, of course, is well know in the art.

Figure 8:
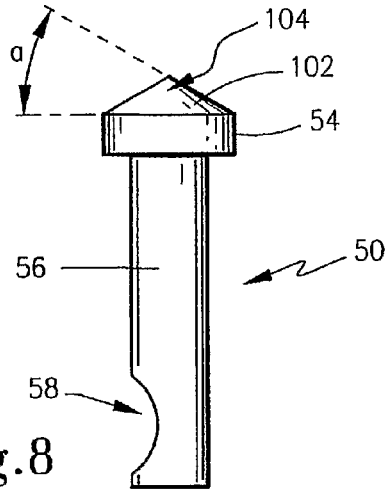
FIG. 8 is a side view in elevation of the release pin of the ratchet wrench shown in FIGS. 1-4.

Release pin 50 is further illustrated in FIG. 8. Here, it may be seen that pin head 54 is located on one end of shaft 56 while the other end of shaft 56 has bay 58 formed therein. Pin head 54 has a conical section 102 which has a side surface 104 formed at an angle "a" with respect to a plane perpendicular to the longitudinal axis of shaft 56.

Figure 9:
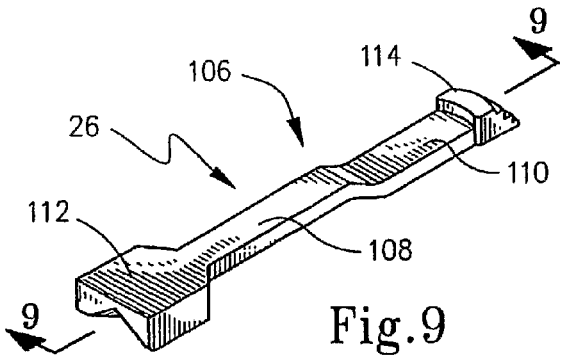
FIG. 9 is a perspective view of a first exemplary embodiment of the slide actuator used with the ratchet wrench of FIGS. 1-4.
Figure 10:
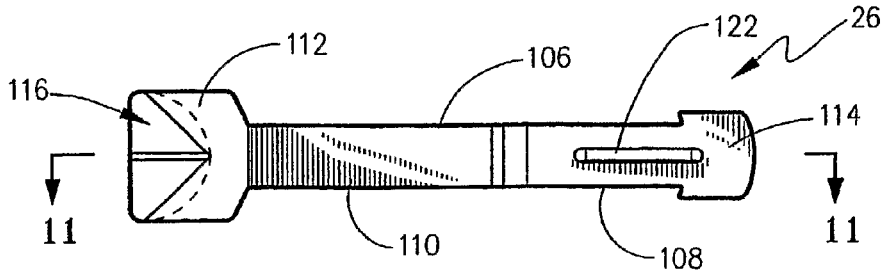
FIG. 10 is a bottom plan view of the slide actuator shown in FIG. 9.
Figure 11:
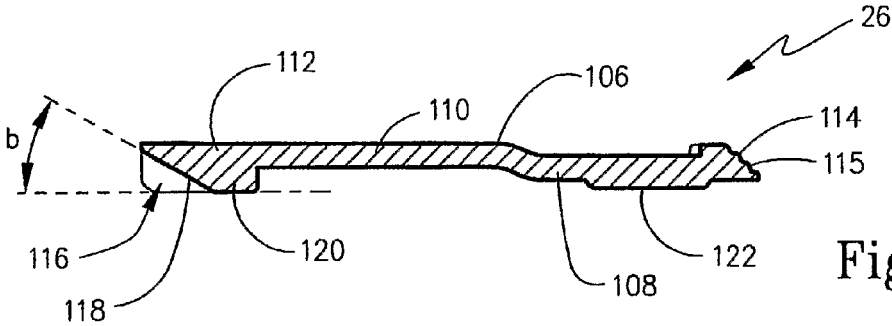
FIG. 11 is a cross-sectional view taken about lines 11-11 of FIG. 10.

The structure of slide actuator 26 is illustrated in greater detail in FIGS. 9-11. Here, it may be seen that slide actuator 26 has a longitudinally extending shank 106 of stepped configuration so as to have a rearward section 108 and a forward section 110 that are offset from one another so as to rest in lower step 82 and upper step 84 of channel 28. An enlarged head 112 is located at the forward end of slide actuator 26 on section 110, and a knob or thumb button 114 is located at a rearward end of slide actuator 26 on section 108. Head 112 includes a cavity 116 having a ramp wall 118 formed at an angle "b" with respect to the plane of base 120. Angle "b" is selected to be about the same as angle "a". Moreover, a rib 122 is centrally and longitudinally disposed on section 108 of shank 106 so as to engage groove 86 in lower step 82. This helps positively guide slide actuator 26 during reciprocal longitudinal movement thereof.

Figure 12A:
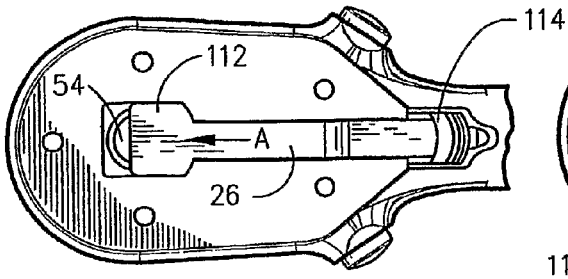
FIGS. 12(*a*) and 12(*b*) are top plan views similar to FIG. 5 but showing the slide actuator positioned on the working head for releasing and depressing the release pin, respectively.
Figure 12B:
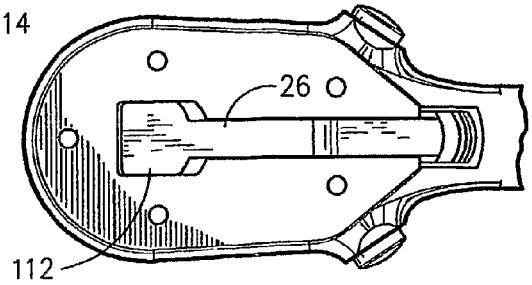

The operation of the quick release mechanism may now be more fully appreciated with reference to FIGS. 12(*a*), 12(*b*), 13(*a*) and 13(*b*). Here, it may be seen that drive member 40 includes an axial bore 124 that has an upper portion 126 of larger diameter than lower portion 128. Thus, bore 124 has a shoulder 130 located at the junction between upper portion 126 and lower portion 128. This shoulder provides a seat for spring 52. To this end, upper portion 126 of bore 124 is configured for close fitted mated engagement with pin head 54 while lower portion 128 of bore 124 is sized for close fitted engagement with shaft 56 of release pin 50. Spring 52 is received in upper portion 126 of bore 124 and is thus trapped between pin head 54 and the seat provided by shoulder 130. Spring 52 operates to bias release pin 50 in an upward direction.

Figure 13A:
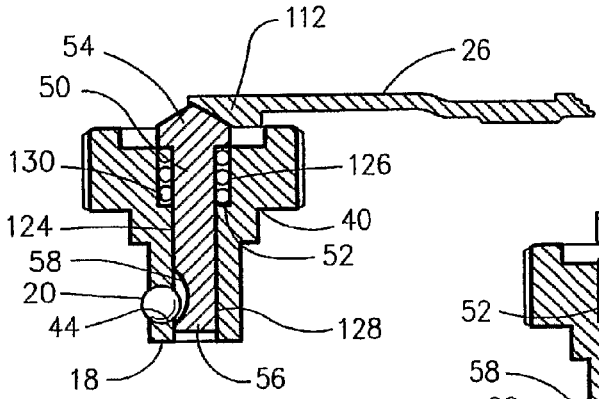
FIGS. 13(*a*) and 13(*b*) are side views in cross-section showing the operation of the slide actuator and release pin corresponding, respectively, to FIGS. 12(*a*) and 12(*b*)
Figure 13B:
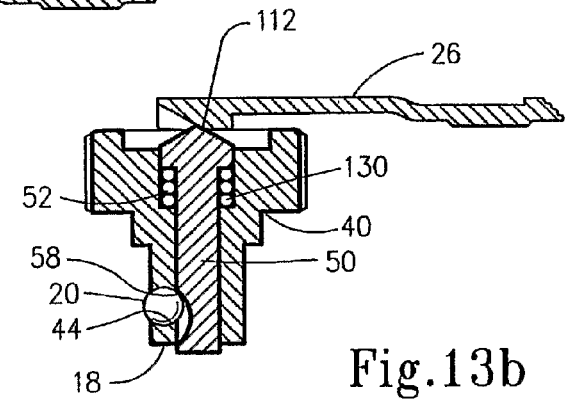

When in the socket retaining position or release state, shown in FIGS. 12(*a*) and 13(*a*), the end of shaft 56 adjacent bay 58 bears against detent ball 20 tending to bias it outwardly in a radial direction. As is shown in FIG. 12(*a*), however, slide actuator 56 may be slid forwardly in a direction of arrow "A" when a user is exerts a forward directed force on thumb knob 114. This advances slide actuator 26 forwardly to the socket release position shown in FIGS. 12(*b*) and 13(*b*). Thus, when a forwardly directed force is exerted on slide actuator 26, ramp wall 118 attacks the outer surface 104 of cone section 102 which depresses release pin 50 downwardly to the release position against the biasing force of spring 52. As is illustrated in FIG. 13(*b*), when release pine 50 is in the release position, bay 58 radially registers with detent ball 20 so that detent ball 20 can move radially inwardly thus removing securing pressure on a socket received on drive stud 18. When the user releases forward force on slide actuator 26, the biasing force of spring 52 acts to return slide actuator 26 from the release position shown in FIGS. 12(*b*) and 13(*b*) to the retained position shown in FIGS. 12(*a*) and 13(*a*).

Figure 14:
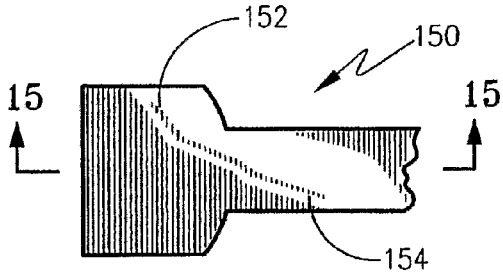
FIG. 14 is a top plan view of the forward portion of a slide actuator according to a second embodiment of the present invention.
Figure 15:
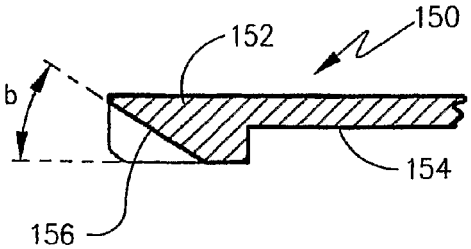
FIG. 15 is a cross-sectional view taken about lines 15-15 of FIG. 14.
Figure 17:
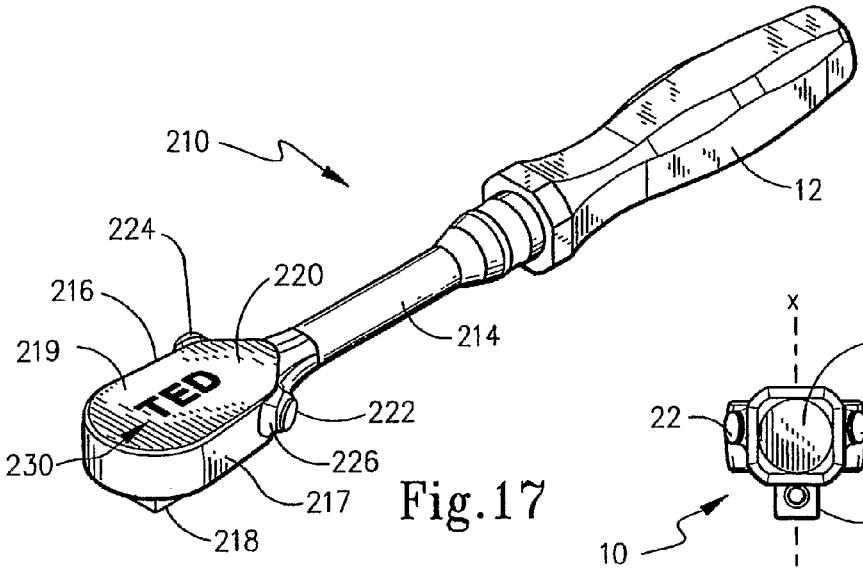
FIG. 17 is a perspective view of a ratchet wrench according to another embodiment of the present invention
Figure 18:
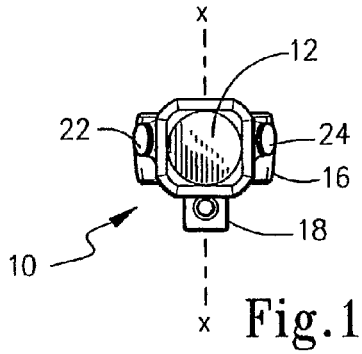
FIG. 18 is an end view in elevation of the ratchet wrench of FIG. 17.
Figure 19:
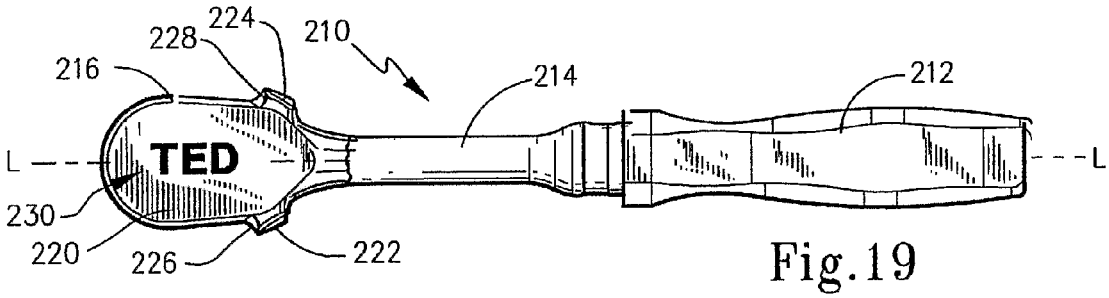
FIG. 19 is a top plan view of the ratchet wrench of FIG. 17.
Figure 20:
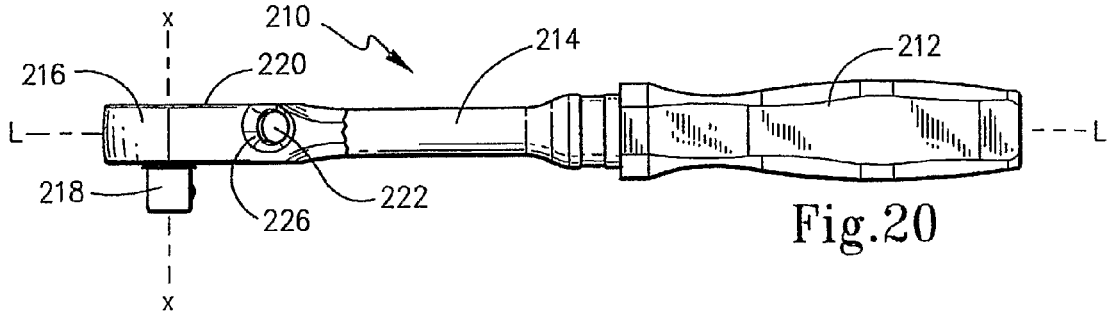
FIG. 20 is a side view in elevation of the ratchet wrench of FIG. 17.
Figure 21:
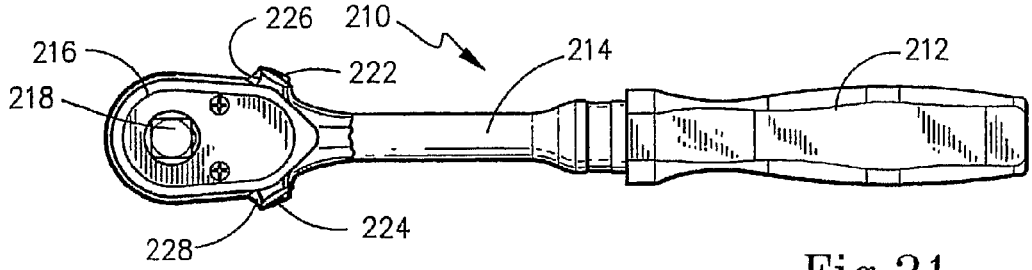
FIG. 21 is a bottom plan view of the ratchet wrench of FIG. 17.

The head portion of a forward portion of a slide actuator 150 according to a second embodiment is illustrated in FIGS. 14 and 15. Here, it may be seen that actuator 150 includes an enlarged head 152 located on shank 154. Here, however, enlarged head 152 does not have the cavity formed therein but is provided with a flat, planar ramp wall 156 that is formed at the angle "b" which corresponds to the angle of the outer surface 104 of cone section 102, as described above.

Figure 16:
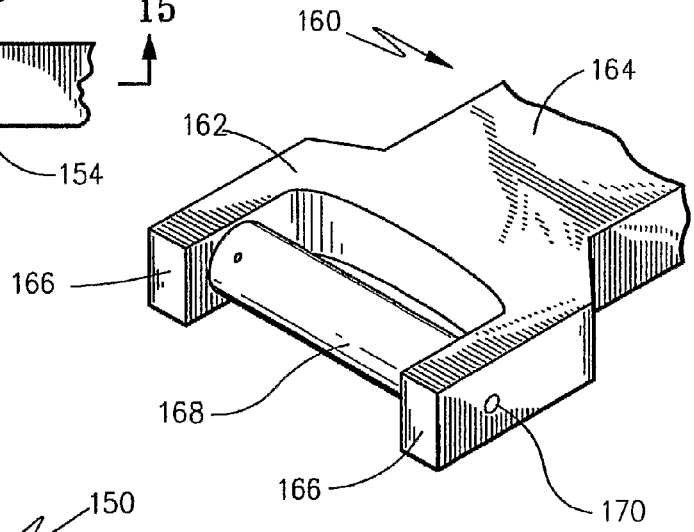
FIG. 16 is a perspective view of the forward portion of a slide actuator according to a third embodiment of the present invention.

FIG. 16 illustrates a third embodiment of the forward portion of a slide actuator 160 which includes an enlarged head 162 formed by a pair of arms 166 at a forward end of shank 164. Arms 166 form a generally U-shaped yoke so that they are in spaced apart, opposed relation to one another. A roller pin 168 is rotatably journaled on an axle pin 170 so that it may rotate relative to axle pin 170 as enlarged head 162 is advanced across pin head 54 of release pin 50.

Another exemplary embodiment of a ratchet wrench according to the present invention is introduced in FIGS. 17-21. Here, ratchet wrench 210 includes a handle 212 provided with a shank 214 that supports a ratchet head 216. As may be seen in these figures, ratchet head 216 includes a rotatable drive shaft 218 projecting in a general perpendicular direction to the longitudinal axis "L" along a drive axis "X". Drive shaft 218, as is known in the art, may be controlled by a ratchet mechanism so that, when handle 212 is rotated in one direction, drive shaft 218 is locked so as to provide a mechanical advantage in applying a force torque piece. When rotated in the opposite direction, the ratchet mechanism releases so as to allow free movement of the handle in the direction opposite the drive direction. However, the ratchet mechanism is switchable so as to reverse the drive direction and the release direction. It should be appreciated by the ordinarily skilled person in this field of invention that, while the present invention is described with respect to a rotatable drive shaft 218, other drive structures could be provided. For example, instead of drive shaft 218, the wrench could include a pre-formed cavity adapted to receive a work piece. In this embodiment, however, drive shaft 218 is adapted to receive various sockets and a set of sockets of different sizes, as is known in the art.

As is illustrated in FIGS. 17-21, the control elements for the ratchet mechanism, which mechanism is described more thoroughly below, are located laterally on either side of ratchet head 216 rather than on top surface 220 thereof, which in this embodiment, does not have a cover plate so that the generally flat and generally uninterrupted upper surface is provided by the upper surface 219 of body portion 217. As is illustrated in these figures, the control elements are in the form of pins 222 and 224 which have head portions protected by shrouds 226 and 228, respectively. Shrouds 226 and 228 help reduce the likelihood of inadvertent movement of the respective pin 222 and 224 during use of the tool so that there is less likelihood of disengagement of the ratchet mechanism from the selected drive direction. Moreover, as is seen in these Figures, top surface 220 of ratchet head 216 thus is devoid of the typical ratchet control lever leaving it relatively uninterrupted so that a trademark or logo 230 may be imprinted thereon here illustrated as the letters "Ted".

The ratchet mechanism used with the ratchet wrench of FIGS. 17-21 is illustrated in greater detail in FIGS. 22-25 and includes many components that are generally of the type known for such ratchet mechanisms. As is known such structures, drive shaft 218 is typically formed integrally with a cylindrical drive member 240 that has a circumferential surface provided with longitudinally oriented drive teeth 242. Drive member 240 is received in a cavity 244 and may rotate therein. Rotational movement of drive member 240, however, is controlled by a pawl element 250 which, in this embodiment, includes a pawl head 52 having a tongue 254 projecting therefrom. Tongue 254 supports an upright post 256 and includes a pair of detents 258 and 259. Pawl head 252 includes pawl teeth sets 261 and 262 which may selectively engage teeth 242 of drive member 240. When a first set of these pawl teeth 261 engage teeth 242 of drive member 240, drive member 240 may rotate relative to casing 232 of ratchet head 216. However, pawl head 252 locks drive member 240 against rotation in an opposite direction. When the other set of pawl teeth 261, 262 engage teeth 242 of drive member 240, drive member 240 rotate in the opposite direction but is locked against counter rotation.

Figure 23:
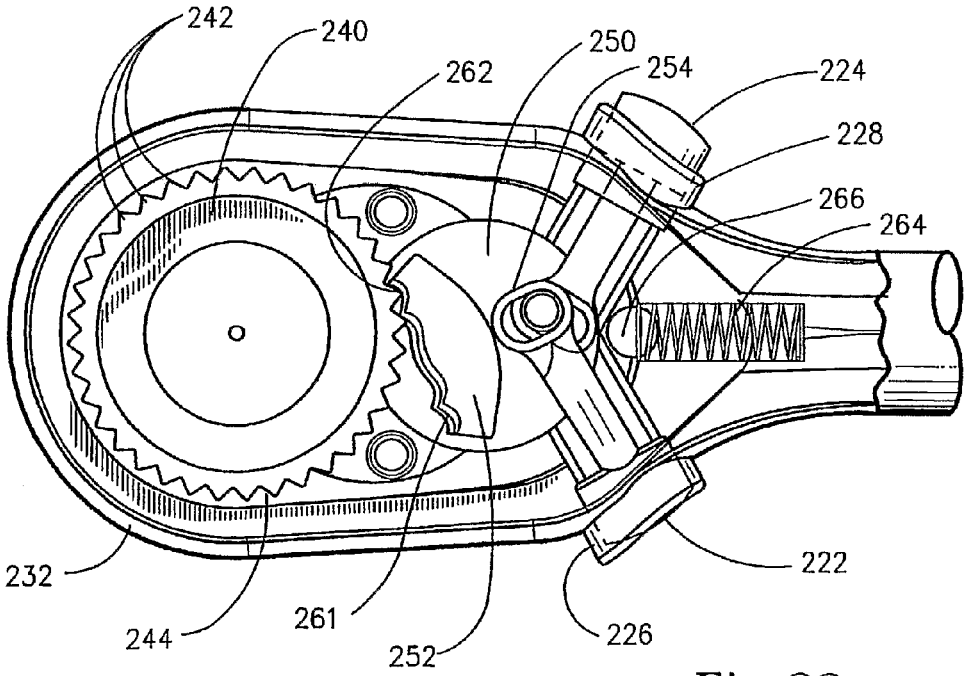
FIG. 23 is a top view in partial cross-section, similar to FIG. 22, showing the ratchet mechanism in a first engaged state.
Figure 24:
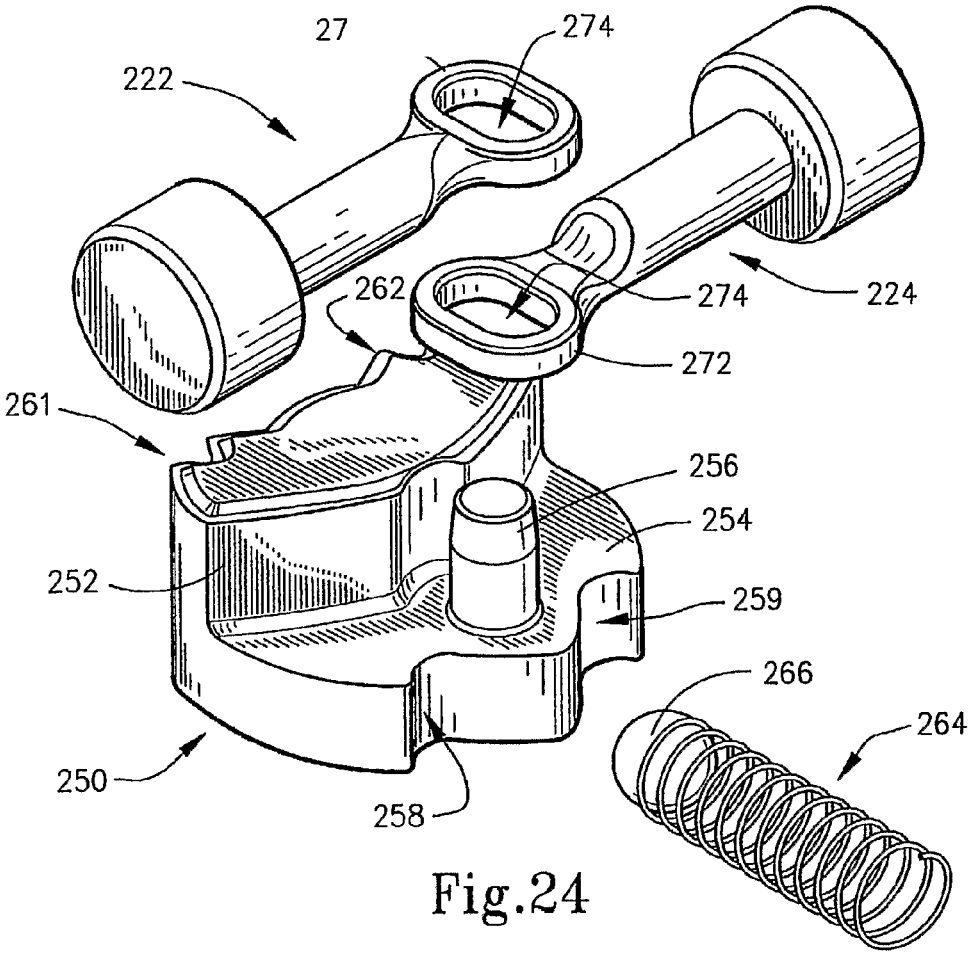
FIG. 24 is an exploded perspective view of some of the elements of the ratchet mechanism illustrated in FIGS. 22 and 23.

One such engagement is illustrated in FIG. 23 where pawl teeth 262 are engaging teeth 242 of drive member 240. To allow rotation in one direction, as is known, pawl element 250 is spring biased into engagement. This is accomplished by means of a spring 64 that carries a detent head 66 that selectively engages detents 258 and 259 when pawl element 250 is toggled between two extreme positions that corresponds to opposite drive directions.

Figure 22:
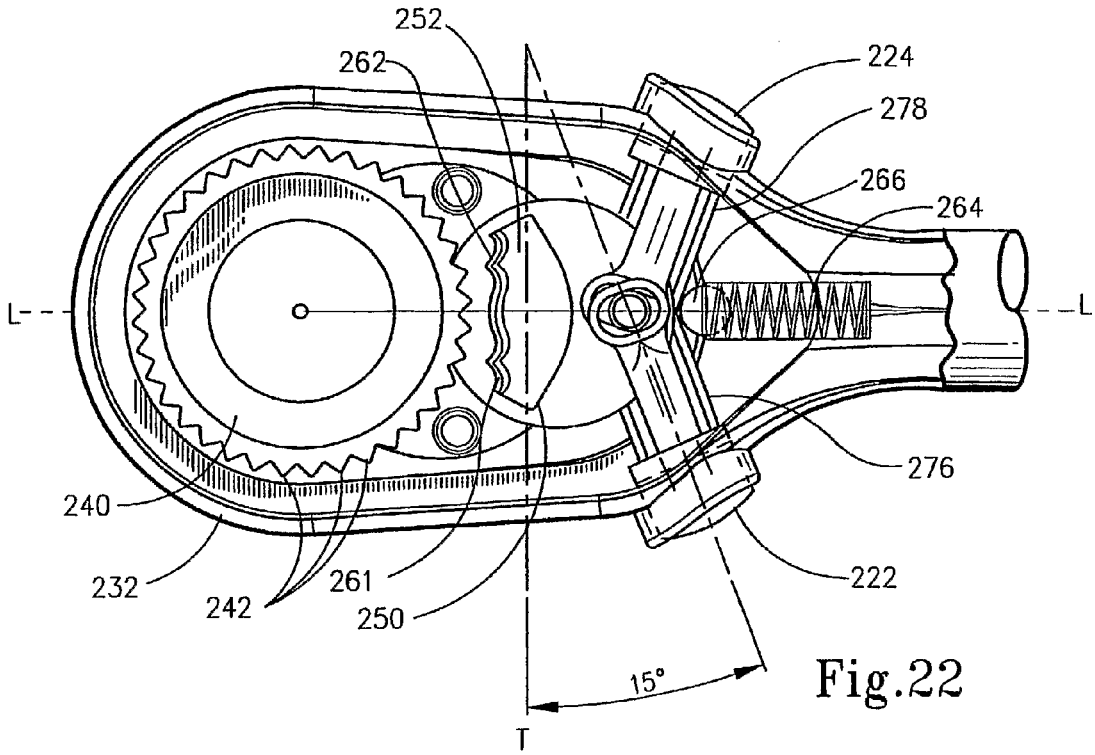
FIG. 22 is a top view in partial cross-section showing the ratchet mechanism of the ratchet wrench of FIG. 17 in a neutral position.
Figure 25:
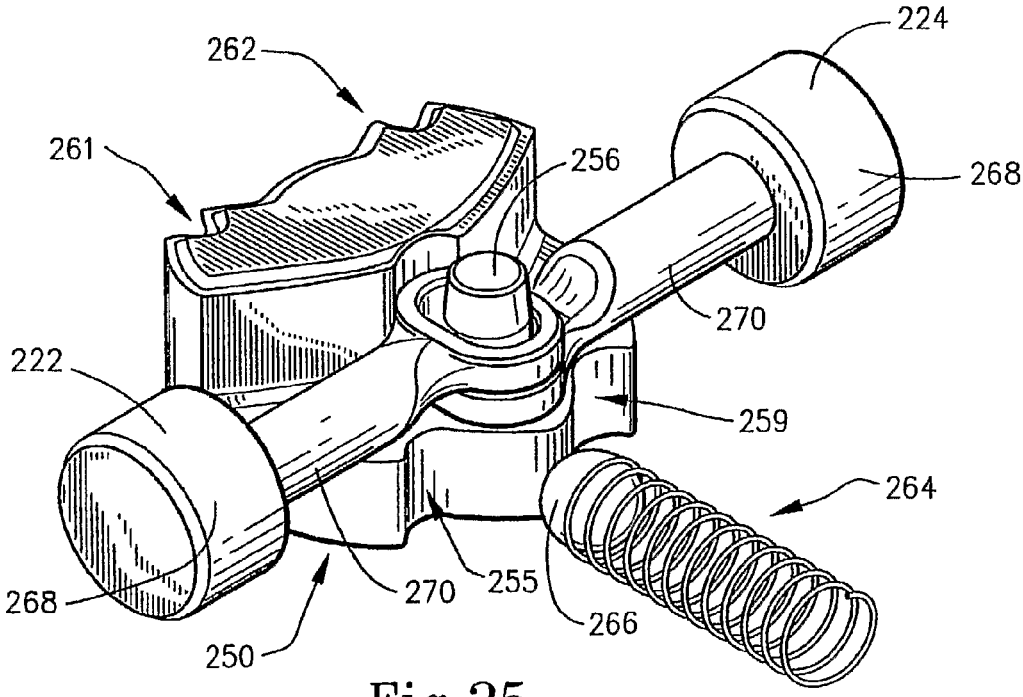
FIG. 25 is a perspective view, similar to FIG. 24, but showing the elements of the ratchet mechanism in an assembled state.

In order to manipulate pawl element 250 between these two positions, then, pins 222 and 224 are provided. Each of pins 222 and 224 includes an enlarged head 268 from which extends a rod 270 that terminates in an annular portion 272 having an oval shaped opening 274 formed therein. Opening 274, as is illustrated in FIG. 25, is adapted to mount over post 256. With reference to FIGS. 22 and 23, it may be seen that these pins 222 and 224 extend through bores 276 and 278, respectively so that they are oriented approximately fifteen degrees from transverse axis "T" that is perpendicular to both longitudinal axis "L" and the rotational axis "X". The manual depression of a selected pin, such as pin 222 shown in FIG. 23, acts to rotate pawl element 250 to engage one set of the pawl teeth with the teeth 242 of drive member 240. Depressing the other pin of 240 serves to reverse this engagement.

Figure 26:
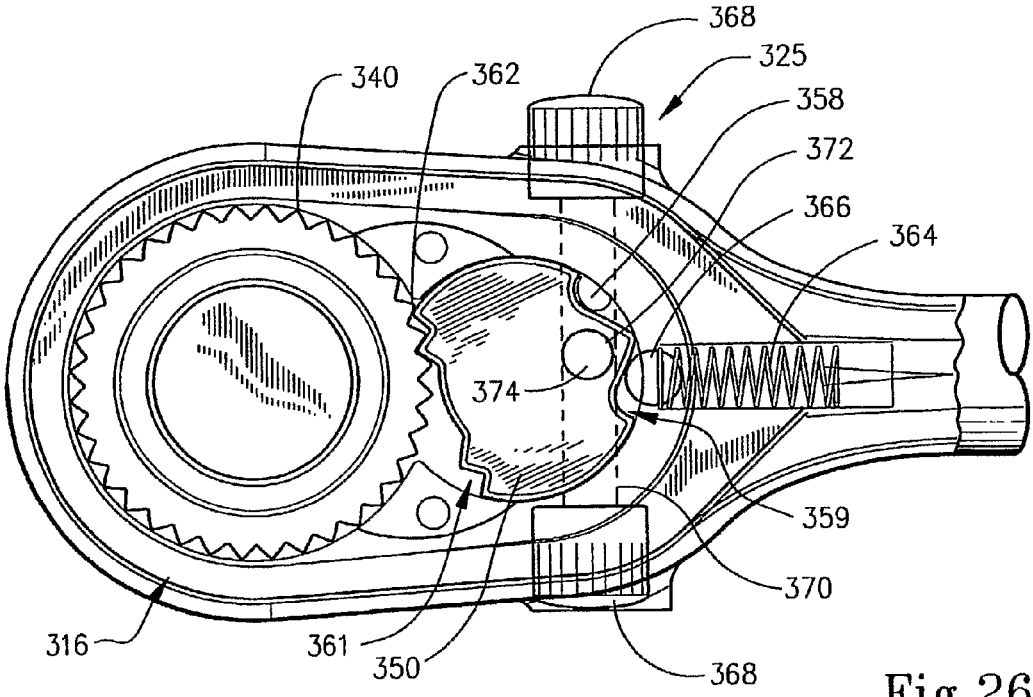
FIG. 26 is a top view in partial cross-section showing another embodiment of a ratchet mechanism according to the present invention.

Another exemplary embodiment of the present invention is illustrated in FIG. 26. Here, drive member 340 is controlled by pawl element 350 that has sets of pawl teeth 361 and 362. Spring 364 again positions a detent head 366 in a selected detent 358, 359. In this embodiment, the control of the ratchet direction is by a single pin 325 which extends transversely through ratchet head 316. Pin 325 includes a rod 370 that supports a pair of head portions 368 on opposite ends thereof. A post 372 projects radially from rod 370 and is received in an oval opening 374 in pawl element 350. Thus, moving pin 325 left or right reverses the engages pawl teeth and thereby changing the ratchet direction.

Figure 27:
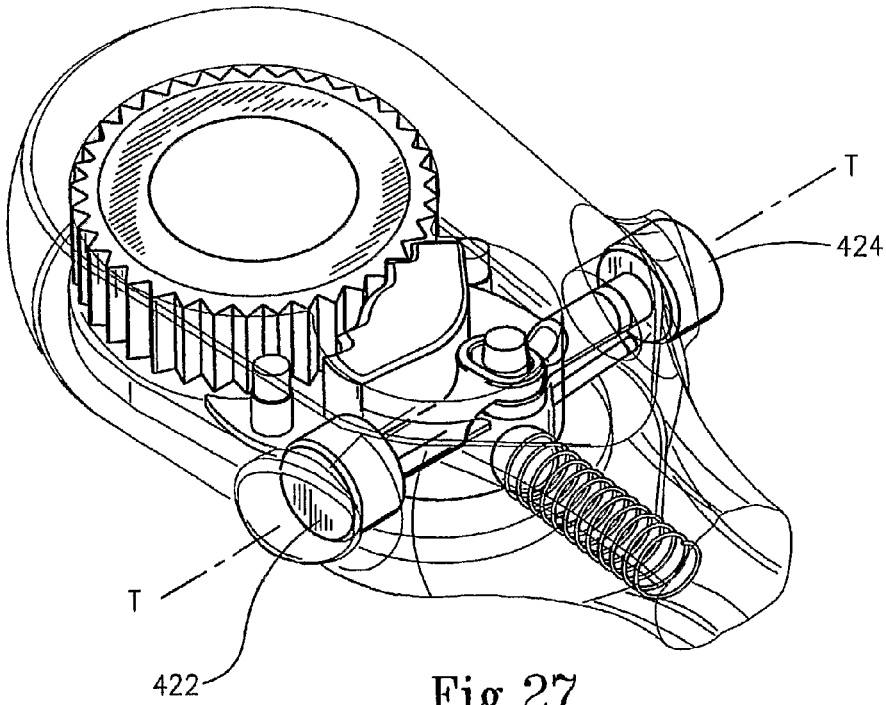
FIG. 27 is a perspective view of a still another embodiment of the ratchet mechanism according to the present invention.

Another exemplary embodiment of the present invention is illustrated in FIG. 27. This embodiment employs pin elements 422 and 424 that are similar to pins 222 and 224 except, in this embodiment, pins 422 and 424 are linearly aligned with one another and along transverse axis "T" instead of being oriented at an angle with respect to axis "T". Thus, the sliding movement of pins 422 and 424 are generally perpendicular to the longitudinal axis "L" and thus the movement corresponds to the movement of pin 325 in FIG. 26.

Figure 28:
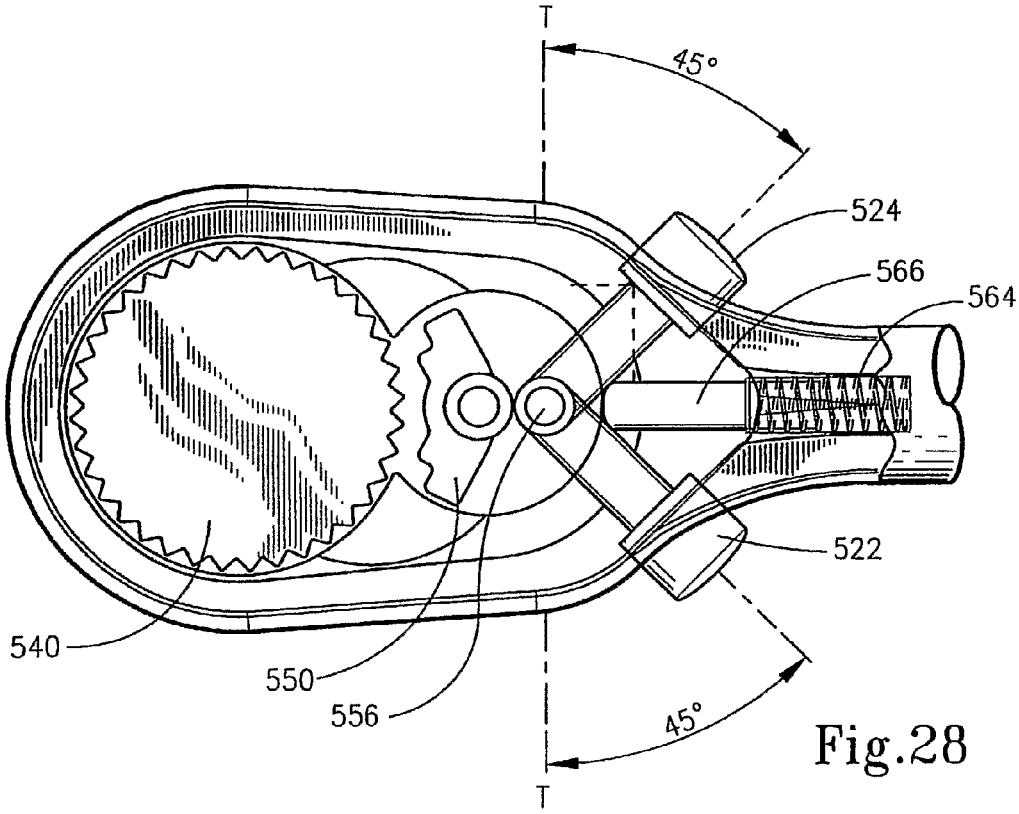
FIG. 28 is a top view in partial cross-section showing another embodiment of the ratchet mechanism according to the present invention.

Another exemplary embodiment of the present invention is illustrated in FIG. 28. Here, drive wheel 540 is again controlled by a pawl 550. Pawl pins 522 and 524 engage a post 556 so that alternate advancement pins 522, 524 change the engagement of pawl 550 to alter the ratchet drive direction. Again, springs 564 biases detent pin 566 to control the ratchet movement. As is noted in FIG. 28, pawl pins 522 and 524 in this embodiment are oriented at a much larger acute angle, such as forty-five or even sixty degrees, with respect to transverse axis "T". From the foregoing then, the pawl pins may be linearly aligned with one another along the transverse axis or oriented at an angle with respect to the axis "T". As contemplated, the angle at which the pawl pins may be oriented relative to the axis "T" can be in a range from about 0° to about 90°, but a desirable range of operation is between about 15° and about 60°.

Figure 29:
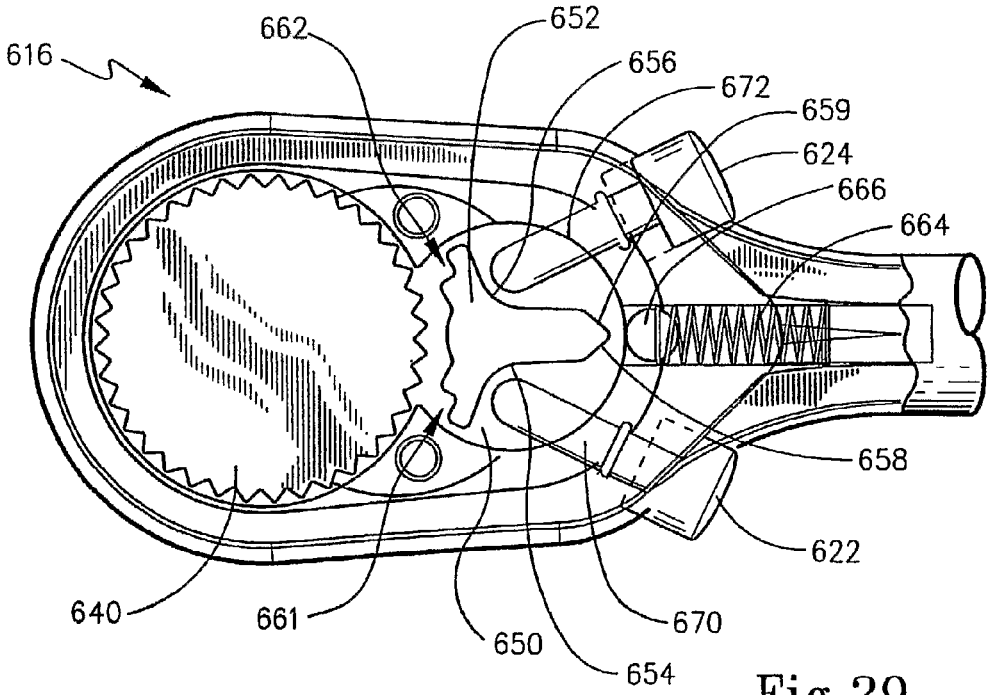
FIG. 29 a top view in partial cross-section showing another embodiment of the ratchet mechanism of the present invention.

In the above discussed embodiments, the control pins positively engage the pawl element either by engaging a post, such as post 256, or by carrying a post, such as post 372 that it engages in opening, such as opening 374 in the pawl element. FIG. 29 illustrates another exemplary embodiment of the present invention that eliminates this positive engagement. Here, ratchet head 616 again carries a drive member 640 that is controlled by a pawl element 650. Pawl element 650 includes a pawl head 652 that is t-shaped in configuration. Pawl head 652 carries pawl teeth sets 661 and 662 and may be rotated by pins 622 and 624. Here, however, T-shaped pawl head 652 has cam surfaces 654 and 656 that are engaged by fingers 670 and 672 carried respectively by pins 622 and 624. Spring 664 again biases a detent head 666 against a wedge shaped detent carried on an end of pawl head 652 opposite pawl teeth 661, 662. This detent portion has detent faces 658 and 659, respectively.

Figure 30:
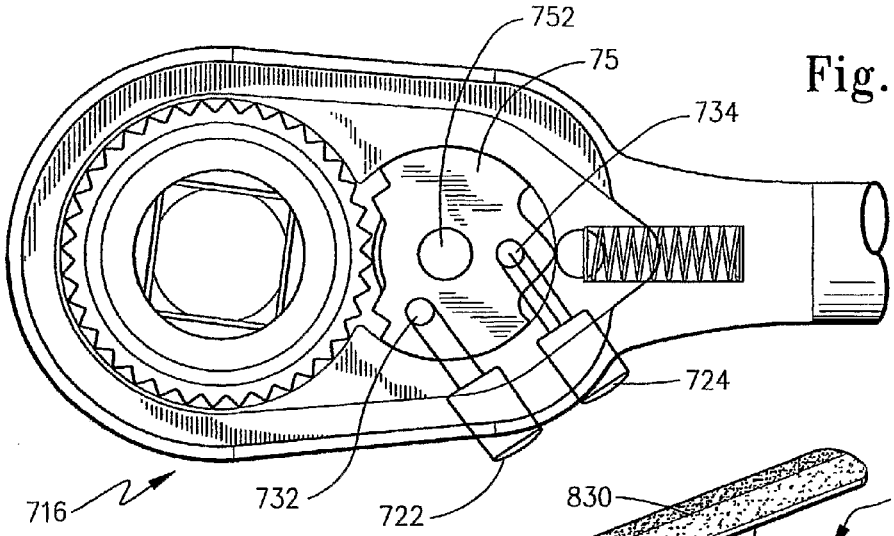
FIG. 30 is a top view in partial cross-section showing another embodiment of the ratchet mechanism of the present invention.

Another exemplary embodiment of the present invention is illustrated in FIG. 30. Here, control pins 722 and 724 are located on a common side of ratchet head 716. They respectively engage posts 732 and 734 on pawl element 750 which rotates about a post 752.

Figure 31:
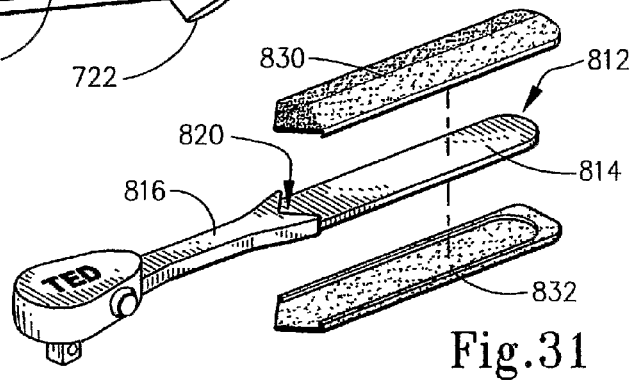
FIG. 31 is an exploded perspective view of a ratchet wrench according to the present invention with an alternate handle structure.
Figure 32:
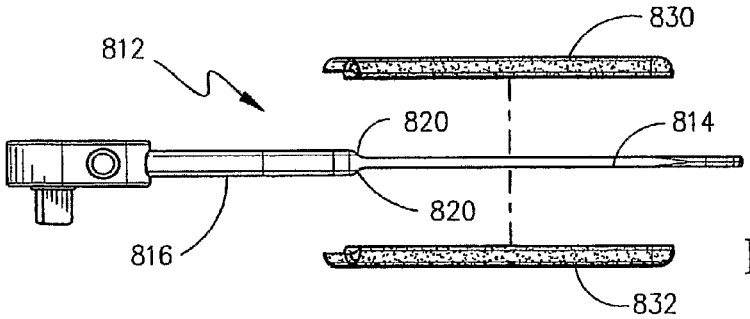
FIG. 32 is an exploded side view in elevation illustrating the handle assembly of FIG. 31.

FIGS. 31 and 32 show an alternate embodiment of the handle for the ratchet wrench of the present invention, and it should be understood that this handle could be used with any of the various ratchet mechanisms described above. Here, handle 812 includes a blade 814 that extends from shank 816 so that a notch shaped shoulders 820 are located at a junction between blade 814 and shank 816. Handle plates 830 and 832 may be secured to blade 814 in any convenient manner, such as by adhesive or by mechanical fasteners. Handle plates 830 and 832 may be made of any suitable material, such as a hard plastic, a soft grip material, metal, wood, etc. Handle plates 830 and 832 may carry trademark or logo information or other information, as desired. Thus, during assembly, a standard ratchet wrench may be custom fit with selected handle plated 830, 832 to customize the wrench for various manufacturers, distributors, or other marketing applications.

Figure 33:
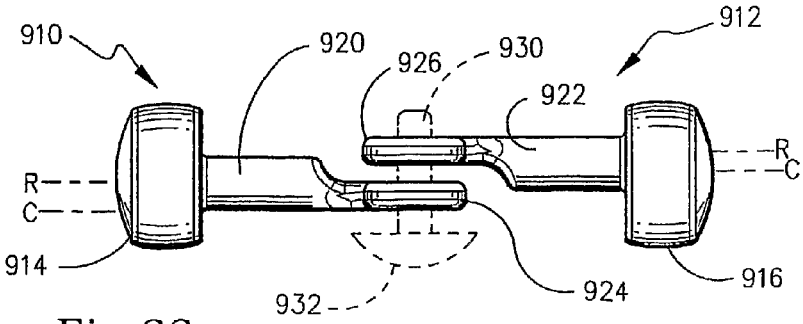
FIG. 33 is a side view in elevation showing an alternative construction of the pawl actuator pins according to the present invention.

With reference, now, to FIG. 33, it may be seen that the pawl actuator pins according to the present invention will be modified in order to reduce the thickness of the working head. More particularly, as is shown in this figure, each of pawl actuator pins 910 and 912 include an enlarged head 914 and 916, respectively. Each of these enlarged heads 914, 916 has a central axis "C". A rod 920 projects from enlarged head 914 and terminates in an annular ring 924. Similarly, a rod 922 extends from enlarged head 916 to terminate in an annular ring 926. Annular rings 924 and 926 are adapted to engage the pawl post 930 of pawl member 932, shown in phantom. As is illustrated in this figure, rods 920 and 922 each extend along a rod axis "R" which is offset from central axis "C" of the enlarged head of the respective pawl actuator 10. Moreover, each of annular rings 924 and 926 have a thickness that is approximately one-half the diameter of rods 920, 922 so that they may generally confront one another so as to have approximately the same thickness as the diameter of the rods when post 930 is engaged thereby. Due to the offset nature of rods 920, 922 and this flattened configuration of the annular rings, a more compact pawl control structure is provided.

It should be appreciated by the ordinarily skilled artisan that the various individual features of the disclosed embodiments may be incorporated in varying combinations. Thus, for example and without limitation, the pawl structure and the pawl actuator pins can be incorporated into a ratchet wrench that does not have the generally flat and generally uninterrupted upper surface for the working head. Similarly, the quick release mechanism disclosed in the exemplary embodiments may be incorporated with a ratchet wrench that does not have the generally flat and generally uninterrupted upper surface or the particular pawl member and pawl actuator pin structure.

Accordingly, the present invention has been described with some degree of particularity directed to the exemplary embodiments of the present invention. It should be appreciated, though, that modifications or changes may be made to the exemplary embodiments of the present invention without departing from the inventive concepts contained herein.

I claim:

1. A ratchet wrench adapted to engage a work piece whereby a user may apply a rotational force thereto with mechanical advantage, comprising:

(A) a forwardly located working head having a generally flat and generally uninterrupted upper surface and a lower surface opposite the upper surface, said working head including a body portion having a cavity formed therein that has a cavity opening through the lower surface of said working head such that said body portion includes a body side wall surrounding the cavity and an outer body side surface, said body portion having at least one actuator bore formed through said body side wall;

(B) a handle extending longitudinally and rearwardly of said working head along a longitudinal axis;

(C) a drive member rotatably disposed in the cavity for rotation in opposite first and second rotational directions about a rotational axis that is generally perpendicular to the longitudinal axis, said drive member adapted to engage the work piece;

(D) a pawl member disposed in the cavity and selectively movable between first and second pawl positions, said pawl member when in the first position operative to permit said drive member to rotate in the first rotational direction and to prohibit said drive member from rotation in the second rotational direction and when in the second position operative to permit said drive member to rotate in the second rotational direction and to prohibit said drive member from rotation in the first rotational direction;

(E) at least one pawl actuator pin disposed in the actuator bore and movable between first and second actuator positions, said actuator pin engaging said pawl member such that when in the first actuator position said pawl member is in the first pawl position and such that when in the second actuator position said pawl member is in the second pawl position;

(F) a retention plate mounted to said body portion, said retention plate sized and adapted to secure said drive member and said pawl member within the cavity when in a mounted state; and (G) a seal member disposed between said drive member and said retention plate.

2. A ratchet wrench according to claim 1 wherein said body side wall includes a retainer groove formed along an inner side surface thereof and extending at least part way around the cavity, and including a retainer clip adapted to removably engage the retainer groove thereby to mount said retention plate to said body portion.

3. A ratchet wrench according to claim 2 wherein said body side wall has an interior shoulder formed thereon with the retainer groove being spaced from said shoulder such that said retention plate is seated against said shoulder when in the mounted state.

4. A ratchet wrench according to claim 3 wherein the cavity opening is generally oval in shape, said retainer clip being generally U-shaped in configuration.

5. A ratchet wrench according to claim 1 wherein said drive member includes an upper drive portion having a cylindrical configuration and provided with a plurality of peripheral drive teeth and a drive stud projecting axially of said drive portion and wherein said pawl member includes pawl teeth operative to engage said drive teeth, said drive stud operative to engage the work piece.

6. A ratchet wrench according to claim 5 wherein said drive stud has a quick release mechanism associated therewith wherein said release mechanism has a retain state that assists in retaining the work piece thereon and a release state wherein said work piece is released from said drive stud, and including a longitudinally oriented and longitudinally movable release actuator disposed in said working head and operative to slideably move between a retracted position and an advanced position, said release actuator operative when in the advanced position to move said quick release mechanism to the release state.

7. A ratchet wrench according to claim 6 wherein said quick release mechanism is biased toward the retain state.

8. A ratchet wrench according to claim 1 wherein the upper surface of said working head is formed by an upper surface of said body portion.

9. A ratchet wrench according to claim 1 including a cover plate mounted to said body portion and having a lower cover surface confronting said body portion and an upper cover surface defining the generally flat and generally uninterrupted upper surface of said working head.

10. A ratchet wrench according to claim 9 wherein said body portion has a plurality of locking ports formed therein and wherein said cover plate has a plurality of locking posts formed on the lower cover surface thereof, said locking posts positioned to engage the locking ports thereby to secure said cover plate to said body portion.

11. A ratchet wrench according to claim 9 wherein the outer body side surface is curved between the upper and lower surfaces of said working head, said cover plate having an outer cover plate edge margin that is rounded so as to present a continuation of the outer body side surface when mounted on said body portion.

12. A ratchet wrench according to claim 1 wherein said body portion has first and second actuator bores formed through said body side wall and including a first pawl actuator pin disposed in the first actuator bore and a second pawl actuator pin dispose in the second actuator bore, said first and second pawl actuator pins engaging said pawl member with each movable between first and second actuator positions, such that (1) when said first pawl actuator pin is in the first actuator position, said second pawl actuator pin is in the second actuator position thereby to place said pawl member is in the first pawl position and (2) when said first pawl actuator pin is in the second actuator position, said second pawl actuator pin is in the second actuator position thereby to place said pawl member is in the second pawl position.

13. A ratchet wrench adapted to engage a work piece whereby a user may apply a rotational force thereto with mechanical advantage, comprising:

(A) a forwardly located working head having an upper surface and a lower surface opposite the upper surface, said working head having a cavity formed therein that has a cavity opening through the lower surface of said working head such that said working head includes a side wall surrounding the cavity and an outer side surface, said working head having first and second actuator bores formed through said side wall;

(B) a handle extending longitudinally and rearwardly of said working head along a longitudinal axis;

(C) a drive member rotatably disposed in the cavity for rotation in opposite first and second rotational directions about a rotational axis that is generally perpendicular to the longitudinal axis, said drive member adapted to engage the work piece;

(D) a pawl member disposed in the cavity and selectively movable between first and second pawl positions, said pawl member when in the first position operative to permit said drive member to rotate in the first rotational direction and to prohibit said drive member from rotation in the second rotational direction and when in the second position operative to permit said drive member to rotate in the second rotational direction and to prohibit said drive member from rotation in the first rotational direction;

(E) first and second pawl actuator pins respectively disposed in the first and second actuator bores, said first and second actuator pins each engaging said pawl member with each movable between first and second actuator positions, such that (1) when said first pawl actuator pin is in the first actuator position, said second pawl actuator pin is in the second actuator position thereby placing said pawl member is in the first pawl position and (2) when said first pawl actuator pin is in the second actuator position, said second pawl actuator pin is in the second actuator position thereby placing said pawl member is in the second pawl position;

(F) including a retention plate mounted to said working head portion, said retention plate sized and adapted to secure said drive member and said pawl within the cavity when in a mounted state; and (G) including a seal member disposed between said drive member and said retention plate.

14. A ratchet wrench according to claim 13 wherein said side wall includes a retainer groove formed along an inner side surface thereof and extending at least part way around the cavity, and including a retainer clip adapted to removably engage the retainer groove thereby to mount said retention plate to said working head.

15. A ratchet wrench according to claim 14 wherein said side wall has an interior shoulder formed thereon with the retainer groove being spaced from said shoulder such that said retention plate is seated against said shoulder when in the mounted state.

16. A ratchet wrench according to claim 15 wherein the cavity opening is generally oval in shape, said retainer clip being generally U-shaped in configuration.

17. A ratchet wrench adapted to engage a work piece whereby a user may apply a rotational force thereto with mechanical advantage, comprising:

(A) a forwardly located working head having a generally flat and generally uninterrupted upper surface and a lower surface opposite the upper surface, said working head including a body portion having a cavity formed therein that has a cavity opening through the lower surface of said working head such that said body portion includes a body side wall surrounding the cavity and an outer body side surface, said body portion having at least one actuator bore formed through said body side wall;

(B) a handle extending longitudinally and rearwardly of said working head along a longitudinal axis;

(C) a drive member rotatably disposed in the cavity for rotation in opposite first and second rotational directions about a rotational axis that is generally perpendicular to the longitudinal axis, said drive member adapted to engage the work piece;

(D) a pawl member disposed in the cavity and selectively movable between first and second pawl positions, said pawl member when in the first position operative to permit said drive member to rotate in the first rotational direction and to prohibit said drive member from rotation in the second rotational direction and when in the second position operative to permit said drive member to rotate in the second rotational direction and to prohibit said drive member from rotation in the first rotational direction; and (E) at least one pawl actuator pin disposed in the actuator bore and movable between first and second actuator positions, said actuator pin engaging said pawl member such that when in the first actuator position said pawl member is in the first pawl position and such that when in the second actuator position said pawl member is in the second pawl position, and wherein said pawl actuator pin includes an enlarged head at a distal end thereof and having a central axis and a rod extending from said enlarged head along a rod axis to terminate in a distal end portion that engages said pawl member, wherein said body portion includes a shroud disposed around at least a portion of the actuator bore and operative to shield the enlarged head of said pawl actuator pin.

18. A ratchet wrench according to claim 17 wherein said pawl member includes a pawl head and a tongue extending therefrom and including a pawl post disposed on said tongue, said pawl actuator pin including an annular ring at the proximal end thereof that is sized and adapted to engage said pawl post.

19. A ratchet wrench according to claim 17 wherein said rod axis is offset from the central axis of said enlarged head.

20. A ratchet wrench adapted to engage a work piece whereby a user may apply a rotational force thereto with mechanical advantage, comprising:

(A) a forwardly located working head having a generally flat and generally uninterrupted upper surface and a lower surface opposite the upper surface, said working head including a body portion having a cavity formed therein that has a cavity opening through the lower surface of said working head such that said body portion includes a body side wall surrounding the cavity and an outer body side surface, said body portion having at least one actuator bore formed through said body side wall;

(B) a handle extending longitudinally and rearwardly of said working head along a longitudinal axis;

(C) a drive member rotatably disposed in the cavity for rotation in opposite first and second rotational directions about a rotational axis that is generally perpendicular to the longitudinal axis, said drive member adapted to engage the work piece;

(D) a pawl member disposed in the cavity and selectively movable between first and second pawl positions, said pawl member when in the first position operative to permit said drive member to rotate in the first rotational direction and to prohibit said drive member from rotation in the second rotational direction and when in the second position operative to permit said drive member to rotate in the second rotational direction and to prohibit said drive member from rotation in the first rotational direction; and (E) at least one pawl actuator pin disposed in the actuator bore and movable between first and second actuator positions, said actuator pin engaging said pawl member such that when in the first actuator position said pawl member is in the first pawl position and such that when in the second actuator position said pawl member is in the second pawl position, and wherein said pawl actuator pin includes an enlarged head at a distal end thereof and having a central axis and a rod extending from said enlarged head along a rod axis to terminate in a distal end portion that engages said pawl member, wherein the rod axis is oriented at an acute angle with respect to a transverse axis that is generally perpendicular to both the longitudinal axis and the rotational axis.

21. A ratchet wrench according to claim 20 wherein the acute angle is between about fifteen and sixty degrees.

22. A ratchet wrench adapted to engage a work piece, whereby a user may apply a rotational force thereto with mechanical advantage, comprising:

(A) a forwardly located working head having an upper surface and a lower surface opposite the upper surface, said working head having a cavity formed therein that has a cavity opening through the lower surface of said working head such that said working head includes a side wall surrounding the cavity and an outer side surface, said working head having first and second actuator bores formed through said side wall;

(B) a handle extending longitudinally and rearwardly of said working head along a longitudinal axis;

(C) a drive member rotatably disposed in the cavity for rotation in opposite first and second rotational directions about a rotational axis that is generally perpendicular to the longitudinal axis, wherein said drive member includes an upper drive portion having a cylindrical configuration and provided with a plurality of peripheral drive teeth and a drive stud projecting axially of said drive portion, said drive stud operative to engage the work piece;

(D) a pawl member disposed in the cavity and selectively movable between first and second pawl positions, said pawl member when in the first position operative to permit said drive member to rotate in the first rotational direction and to prohibit said drive member from rotation in the second rotational direction and when in the second position operative to permit said drive member to rotate in the second rotational direction and to prohibit said drive member from rotation in the first rotational direction, and wherein said pawl member includes pawl teeth operative to engage said drive teeth; and (E) first and second pawl actuator pins respectively disposed in the first and second actuator bores, said first and second actuator pins each engaging said pawl member with each movable between first and second actuator positions, such that (1) when said first pawl actuator pin is in the first actuator position, said second pawl actuator pin is in the second actuator position thereby placing said pawl member is in the first pawl position and (2) when said first pawl actuator pin is in the second actuator position, said second pawl actuator pin is in the second actuator position thereby placing said pawl member is in the second pawl position.

23. A ratchet wrench according to claim 22 wherein said drive stud has a quick release mechanism associated therewith wherein said release mechanism has a retain state that assists in retaining the work piece thereon and a release state wherein said work piece is release from said drive stud, and including a longitudinally oriented and longitudinally movable release actuator disposed in said working head and operative to slideably move between a retracted position and an advanced position, said release actuator operative when in the advanced position to move said quick release mechanism to the release state.

24. A ratchet wrench adapted to engage a work piece whereby a user may apply a rotational force thereto with mechanical advantage, comprising:

(A) a forwardly located working head having an upper surface and a lower surface opposite the upper surface, said working head having a cavity formed therein that has a cavity opening through the lower surface of said working head such that said working head includes a side wall surrounding the cavity and an outer side surface, said working head having first and second actuator bores formed through said side wall;

(B) a handle extending longitudinally and rearwardly of said working head along a longitudinal axis;

(C) a drive member rotatably disposed in the cavity for rotation in opposite first and second rotational directions about a rotational axis that is generally perpendicular to the longitudinal axis, said drive member adapted to engage the work piece;

(D) a pawl member disposed in the cavity and selectively movable between first and second pawl positions, said pawl member when in the first position operative to permit said drive member to rotate in the first rotational direction and to prohibit said drive member from rotation in the second rotational direction and when in the second position operative to permit said drive member to rotate in the second rotational direction and to prohibit said drive member from rotation in the first rotational direction; and (E) first and second pawl actuator pins respectively disposed in the first and second actuator bores, wherein each of said first and second pawl actuator pins includes an enlarged head having at a distal end thereof and having a central axis and a rod extending from said enlarged head along a rod axis to terminate in a distal end portion that engages said pawl member, said first and second actuator pins each movable between first and second actuator positions, such that (1) when said first pawl actuator pin is in the first actuator position, said second pawl actuator pin is in the second actuator position thereby placing said pawl member is in the first pawl position and (2) when said first pawl actuator pin is in the second actuator position, said second pawl actuator pin is in the second actuator position thereby placing said pawl member is in the second pawl position.

25. A ratchet wrench according to claim 24 wherein said pawl member includes a pawl head and a tongue extending therefrom and including a pawl post disposed on said tongue, each said pawl actuator pin including an annular ring at the proximal end thereof that is sized and adapted to engage said pawl post.

26. A ratchet wrench according to claim 24 wherein said rod axis of each of said first and second pawl actuator pins is offset from the central axis of its respective said enlarged head.

27. A ratchet wrench according to claim 24 wherein said body portion includes a shroud disposed around at least a portion of each of the first and second actuator bores and operative to shield the enlarged head of a respective one of said first and second pawl actuator pins.

28. A ratchet wrench according to claim 24 wherein the rod axis of each of said first and second pawl actuator pins is oriented at an acute angle with respect to a transverse axis that is generally perpendicular to both the longitudinal axis and the rotational axis.

29. A ratchet wrench according to claim 28 wherein the acute angle is between about fifteen and sixty degrees.

* * * * *